US009073611B2

(12) United States Patent
Berenson

(10) Patent No.: US 9,073,611 B2
(45) Date of Patent: Jul. 7, 2015

(54) RECREATIONAL FLOTATION DEVICE

(71) Applicant: AQUA-LEISURE INDUSTRIES, INC., Avon, MA (US)

(72) Inventor: Steven M. Berenson, Canton, MA (US)

(73) Assignee: AQUA-LEISURE INDUSTRIES, INC., Avon, MA (US)

( * ) Notice: Subject to any disclaimer, the term of this patent is extended or adjusted under 35 U.S.C. 154(b) by 190 days.

(21) Appl. No.: 13/856,751

(22) Filed: Apr. 4, 2013

(65) Prior Publication Data

US 2013/0267135 A1 Oct. 10, 2013

Related U.S. Application Data

(60) Provisional application No. 61/620,169, filed on Apr. 4, 2012.

(51) Int. Cl.

| | |
|---|---|
| ***B63B 35/78*** | (2006.01) |
| ***A63B 69/14*** | (2006.01) |
| ***B63B 35/73*** | (2006.01) |
| *B63B 7/08* | (2006.01) |

(52) U.S. Cl.

CPC ..... *B63B 35/78* (2013.01); *A63B 69/14* (2013.01); *B63B 7/08* (2013.01); *B63B 35/73* (2013.01); *A63B 2225/605* (2013.01); *A63B 2208/03* (2013.01); *A63B 2209/10* (2013.01); *A63B 2210/50* (2013.01); *A63B 2225/62* (2013.01); *A63B 2208/12* (2013.01)

(58) Field of Classification Search

CPC ..... A47C 15/006; B63B 35/78
USPC ..... 114/352–354; 441/65, 66, 74; D21/769
See application file for complete search history.

(56) References Cited

U.S. PATENT DOCUMENTS

| | | | | |
|---|---|---|---|---|
| 1,960,474 | A | 5/1934 | Browne | |
| 2,207,025 | A | 7/1940 | Rison | |
| D225,183 | S | 11/1972 | Waters | |
| 3,871,042 | A | 3/1975 | Farmer | |
| D293,012 | S | 12/1987 | Storey et al. | |
| 5,046,978 | A | 9/1991 | Howerton | |
| 5,295,883 | A * | 3/1994 | Moran | 441/65 |
| 5,476,404 | A | 12/1995 | Price | |
| D406,870 | S | 3/1999 | Bauman | |
| D466,176 | S | 11/2002 | Peterson | |
| 6,485,344 | B2 | 11/2002 | Arias | |
| D469,494 | S | 1/2003 | Arias | |
| D610,216 | S | 2/2010 | Le Gette et al. | |
| 8,025,541 | B2 * | 9/2011 | Churchill et al. | 441/40 |
| 8,066,540 | B2 | 11/2011 | Le Gette et al. | |

(Continued)

OTHER PUBLICATIONS

King Kool Lounge, Intex 1994 Catalog, p. 30.
Ultimate Pool Lounge, Aqua-Leisure 1993 Catalog, p. 13.

(Continued)

*Primary Examiner* — Edwin Swinehart
(74) *Attorney, Agent, or Firm* — Lando & Anastasi LLP

(57) ABSTRACT

A recreational floatation device is disclosed. In one example, the recreational floatation device comprises a main body having a front portion and members extending substantially parallel from the front portion, a seat portion attached to the main body between the two parallel members and adjacent to the front portion, for receiving and supporting a user of the recreational flotation device in a seated portion, and a floating board removably attachable to said main body, when positioned between the parallel members.

16 Claims, 8 Drawing Sheets

(56) References Cited

U.S. PATENT DOCUMENTS

| | | | | |
|---|---|---|---|---|
| 2002/0049017 | A1 | 4/2002 | Ross | |
| 2009/0004936 | A1* | 1/2009 | Mollis | 441/66 |

OTHER PUBLICATIONS

Designer Fashion #43028, Bestway 2003 Catalog, p. 51.
Kool Lounge #43011, Bestway 2003 Catalog, p. 51.
King Kool Lounge #43022, Bestway 2003 Catalog, p. 52.
Style 9048 Inflatable Lounge Chair, Swimline (ILP, Inc.) 1999 Catalog, p. A1.
Style 9049 Pontoon Lounger, Swimline (ILP, Inc.) 1999 Catalog, p. A1.
Style 9041 Deluxe Lounge Chair, Swimline (ILP, Inc.) 1999 Catalog, p. 19.
Lounge Chair 8-5072, Bestway 2000 Catalog, p. 15.
Bi-Lokoo Cool Lounge BW#8-5478, Bestway 2002 Catalog.
My Baby Float, Intex 1994 Catalog, p. 17.
Snoopy Baby Float, Intex 1994 Catalog, p. 17.
Team Mickey Baby Float, Intex 1994 Catalog, p. 17.
Sun Brite My First Boat, Intex 1994 Catalog, p. 17.
Just for Baby Pool Seat—Aqua-Leisure 1993 Catalog, p. 7.
Pedal Float Lounge, Intex 2001 Catalog, p. 34.
Mini Racer Baby Boat, Bestway 2003 Catalog, p. 36.
Baby Boat Racer, Bestway 2003 Catalog, p. 36.
Race Car Baby Care Seat, Bestway 2003 Catalog, p. 36.
Designer Baby Boat, Bestway 2003 Catalog, p. 36.
Double Ring Float, Bestway 2000 Catalog, p. 8.
Banana Chair, Bestway 2000 Catalog, p. 8.
Pedal Car, Bestway 2000 Catalog, p. 28.
Various Child/Baby Boats, Bestway 2000 Catalog, pp. 73-74.
Swimclass Baby Boat, packaging contains copyright 2003.
Aqua-Leisure Baby Boat, packaging contains copyright 1992.
Aqua-Leisure Squirtin' Tootin' Tugboat, packaging contains copyright 2001.

* cited by examiner

RECREATIONAL FLOTATION DEVICE

RELATED APPLICATIONS

This application claims priority under 35 U.S.C. §119(e) to U.S. Provisional Application Ser. No. 61/620,169, entitled "RECREATIONAL FLOTATION DEVICE," filed on Apr. 4, 2012, which is hereby incorporated herein by reference in its entirety.

BACKGROUND

1. Field of the Invention

At least one example in accordance with the present invention relates generally to floating pool and beach toys for children.

2. Discussion of Related Art

Flotation tubes are commonly utilized to keep young children (babies or toddlers) floating at the surface of a body of water while preventing the child from becoming submerged in the water. For example, flotation tubes such as inflatable bubbles, foam bubbles, life preservers and inflatable arm bands are oftentimes attached to a child to keep the child afloat. Young children are often placed on or in flotation tubes such as inflatable boats to keep the child above water. Older children may use flotation devices as training tools to learn how to swim.

SUMMARY

According to one aspect, a recreational floatation device is disclosed. In one embodiment, the device includes a U-shaped body having a front portion and members substantially parallel to each other, and extending from the front portion, and a kickboard detachably coupled to the flotation device, disposed between the parallel members, wherein the kickboard is configured to be positioned within the flotation device in a plurality of positions.

In one example, the kickboard placed in a first position of the plurality of positions is configured to be coupled to the U-shaped body and substantially positioned between the parallel members of the flotation device. The kickboard can be placed in a second position of the plurality of positions and can be configured to be coupled to the U-shaped body and partially extending outside of the flotation device. The kickboard can also be placed in a third position of the plurality of positions and can be configured to be detached and removed from the flotation device.

In one example, the flotation device comprises an inflatable tube, a seat and an upper support, wherein the flotation tube is contoured around the seat and the upper support. In another example, the kickboard is contoured on one side to fit around a torso of a user. In at least one example, the upper support and the parallel members form a space configured to fit the kickboard. The seat can be configured to support weight of a user in a sitting position. The upper support can be contoured to allow at least a portion of the kickboard to rest uniformly on top of the upper support. In addition, the seat can comprise two openings configured to allow user's legs to fit through the two openings.

In another example, the flotation device and the kickboard are inflatable. The kickboard can be configured to be detachably coupled to the flotation device using hook and loop fasteners. The hook and loop fasteners can comprise a first portion of the hook and loop fasteners is disposed on the kickboard and a second portion of the hook and loop fasteners is disposed on the flotation device. In another example, the kickboard can configured to be detachably coupled to the flotation device using fastening straps.

According to another aspect, a recreational floatation device comprises a main body having a front portion and members extending substantially parallel from the front portion, a seat portion attached to the main body between the two parallel members and adjacent to the front portion, for receiving and supporting a user of the recreational flotation device in a seated portion, and a floating board removably attachable to said main body, when positioned between the parallel members.

In a first position, the floating board can be entirely positioned within the main body and removably attached thereto. In a second position, the floating board is partly positioned within the main body and removably attached thereto. In one example, the recreational flotation device further comprises a support member disposed between the parallel members and adjacent the seat portion, for supporting the floating board when the floating board is placed between the members. The seat portion of the flotation device can include at least one opening. In one example, the kickboard is configured to be detachably coupled to the flotation device using a releasable fastening mechanism.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION

Figure 1:
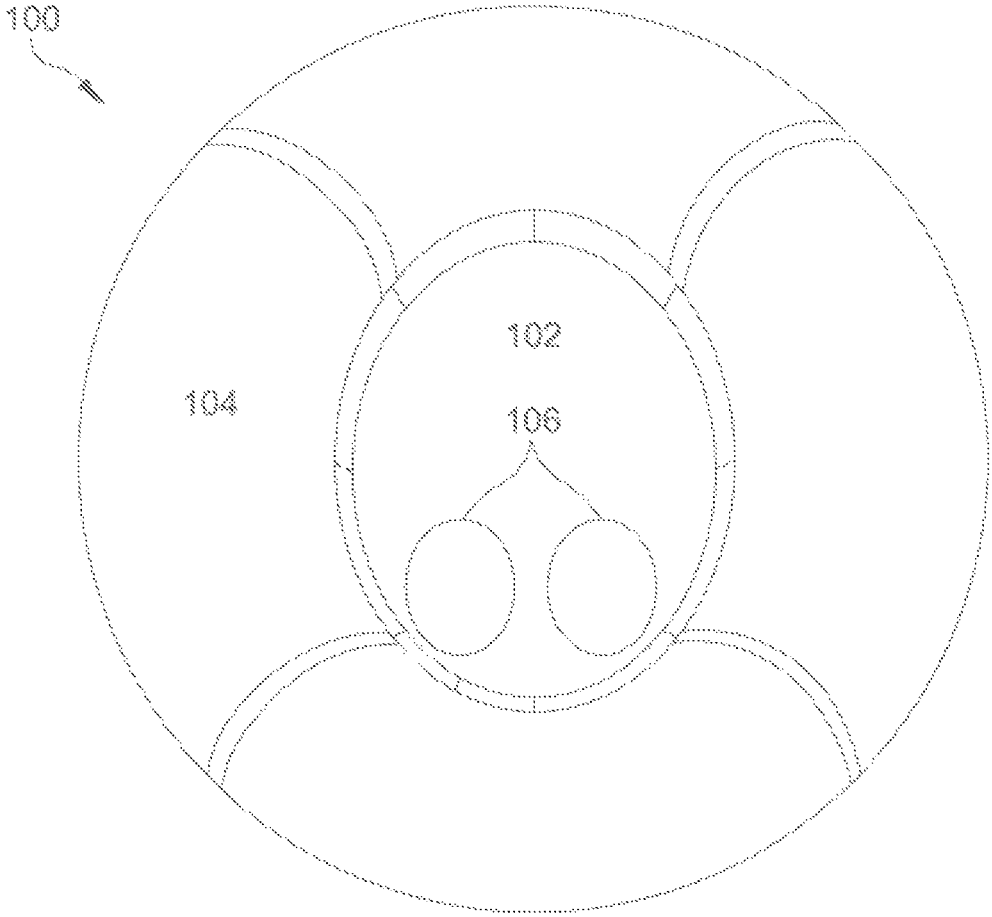
FIG. 1 PRIOR ART
FIG. 1 is depicts an example of typical inflatable boat used as a flotation device.

As described above, typical inflatable boats (or baby boats) are used for young children for entertainment and safety purposes. FIG. 1 shows a typical inflatable boat which may include a bottom 102 affixed to and surrounded by a ring-like flotation tube 104. The bottom 102 may include apertures 106 through which a child's legs may be inserted. The bottom 102 functions as a seat, and in cooperation with the flotation tube 104, supports the weight of the child in a sitting position and keeps the child afloat while the flotation tube 104 rests on top of the water. While useful for the safety of a child in water, the inflatable boat does not play a role in teaching a child how to swim.

Another type of flotation device is a swimming board or a kickboard, which is normally used as a training device to teach older children how to swim. A typical kickboard may include a flat rectangular body having a front and a back portion. The front portion may be rounded to provide smoother movement through water and the back portion may be contoured to fit around a child's torso. The front portion may include apertures or slits used as hand holds. In using the kickboard, the child typically lies on top of the kickboard in a swimming position while holding on to the front portion of the kickboard, and the child's legs kick to propel the child through the water. The front portion of the kickboard emerges from the water, while the back portion supports the weight of the child, keeping the child afloat.

The transition from sitting in the water to using the kickboard to learn how to swim can be challenging for a child. Therefore, embodiments described herein and illustrated in FIGS. 2-8, include a recreational flotation device that is a combination of a baby boat and a kickboard. The combined baby boat and kickboard helps to transition the child from a stationary sitting position into an active swimming position. When the child is younger, the child can use the recreational flotation device as an inflatable boat. As the child's comfort level, age and skill in the water grows, the child can lean forward on the kickboard portion and use the combined boat and kickboard to feel more comfortable in the swimming position. Finally, when the child grows more comfortable in the swimming position, the kickboard portion can be removed from the boat portion and used independently. Both the boat portion and the kickboard portion can be easily stored and transported.

Figure 2:
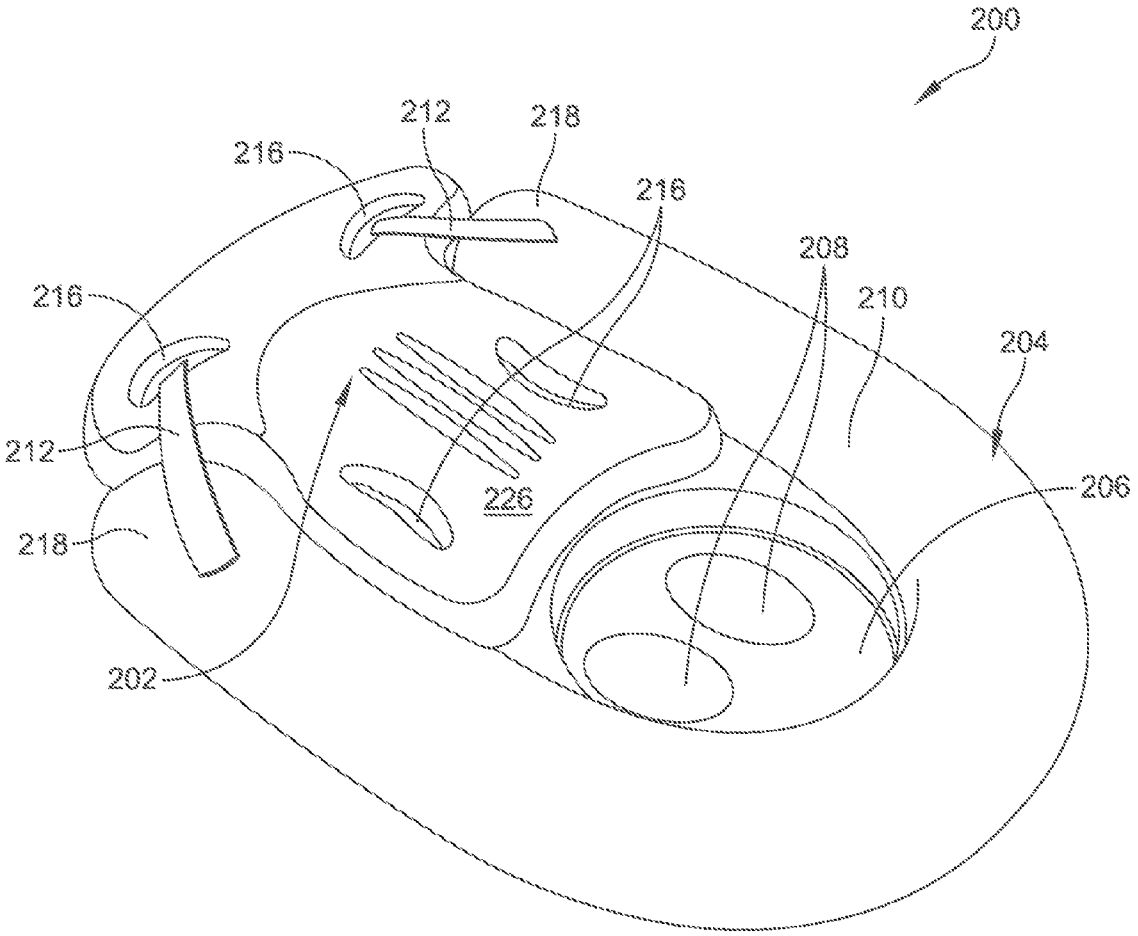
FIG. 2 is a perspective view of a flotation device arranged in a boat stage, according to one embodiment.

FIGS. 2-8 illustrate one example of a recreational flotation device 200 during various stages of assembly including a "boat stage," an "extended stage" and a "separation stage." FIG. 2 illustrates one example of the flotation device 200, including a kickboard 202 and a boat portion 204, in the boat stage of assembly. The kickboard 202 is detachably coupled to the boat portion in the various stages of assembly. In some embodiments, both the kickboard 202 and the boat portion 204 are inflatable and can support the weight of a child in the water. In other embodiments, the kickboard may not be inflatable and may be made from a foam or plastic material, such as for example EVA or HDPE material.

The boat portion 204 includes a well 206 having apertures 208, an upper support 220, a flotation tube 210, and fastening straps 212. As shown in this example, the kickboard 202 includes two pairs of apertures or slits 216, which can be used as hand-holds as further described below. In the boat stage, the child's legs fit through the apertures 208 and the child sits in the well 206. The well 206 is submerged in water while the flotation tube 210 supports the weight of the floating child.

Figure 4:
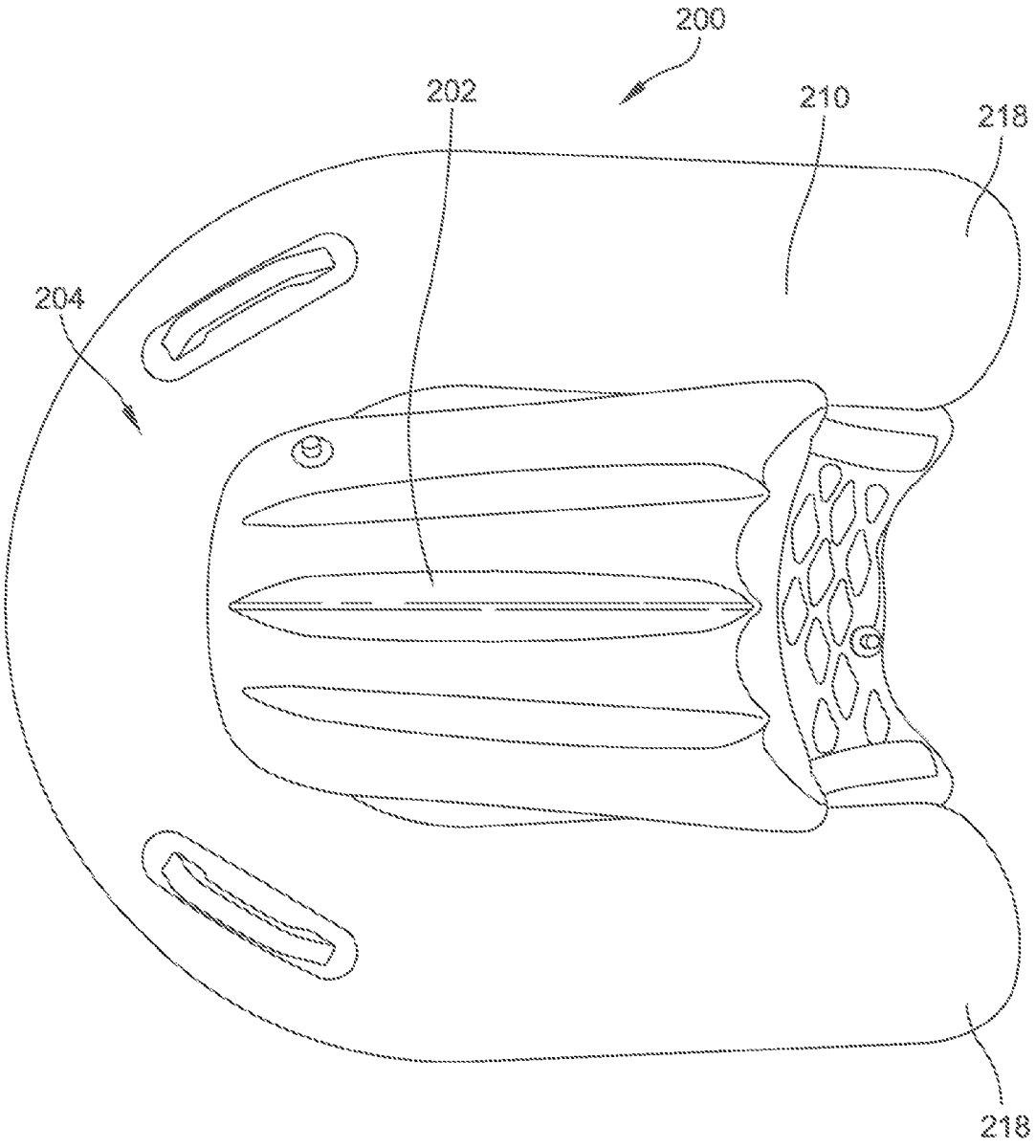
FIG. 4 is a top view of a flotation device arranged for storage, according to an alternative embodiment.
Figure 5:
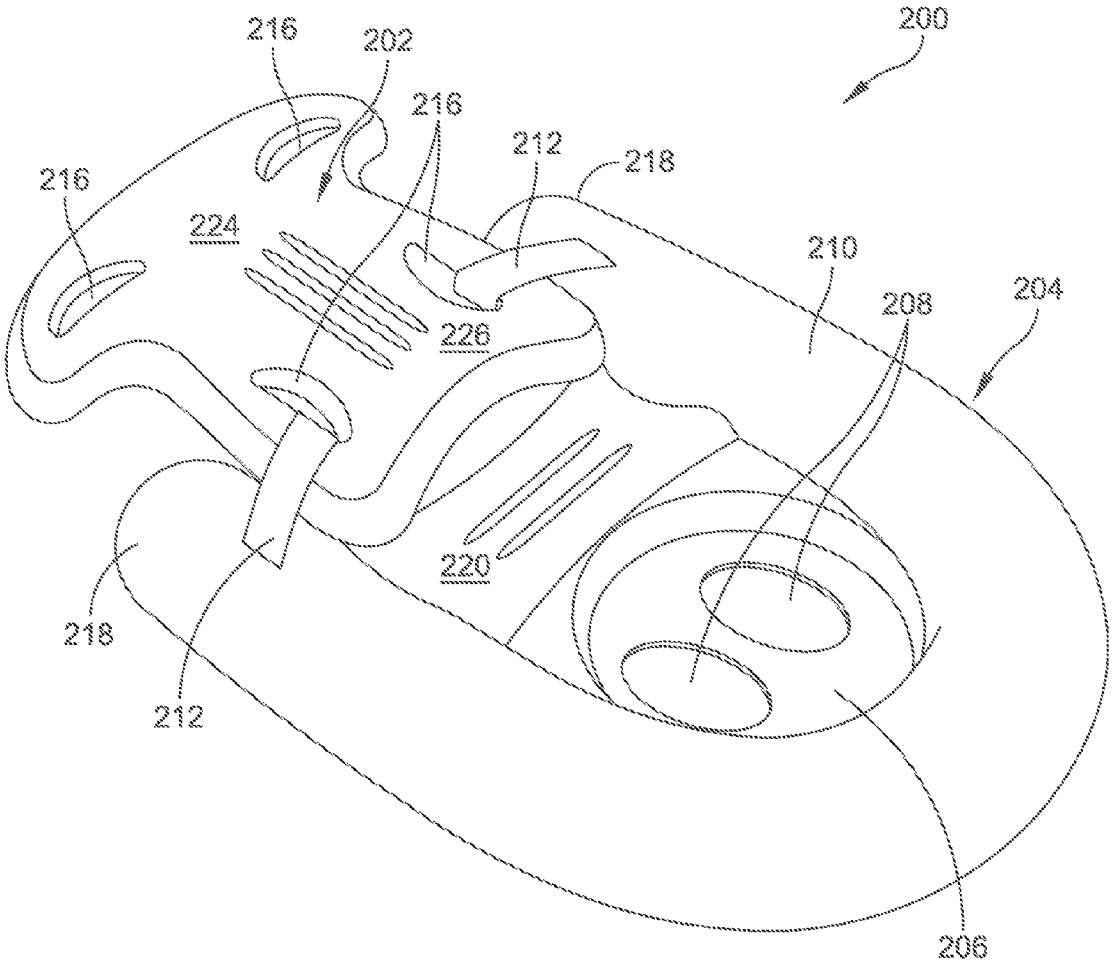
FIG. 5 is a perspective view of a flotation device arranged in an extended stage, according to one embodiment.

The flotation tube 210 has an elongated shape forming a "U-shape" with a rounded front portion, which partially surrounds the well 206 and the upper support 220 (shown in FIGS. 4 and 5), and two extensions 218 on a back portion of the flotation tube 210 extending from the front portion. As shown in FIGS. 4 and 5, the extensions 218 may be substantially parallel to each other and together with the upper support 220 form a space for the kickboard 202 to be placed within the bounds of the boat portion 204.

Figure 3:
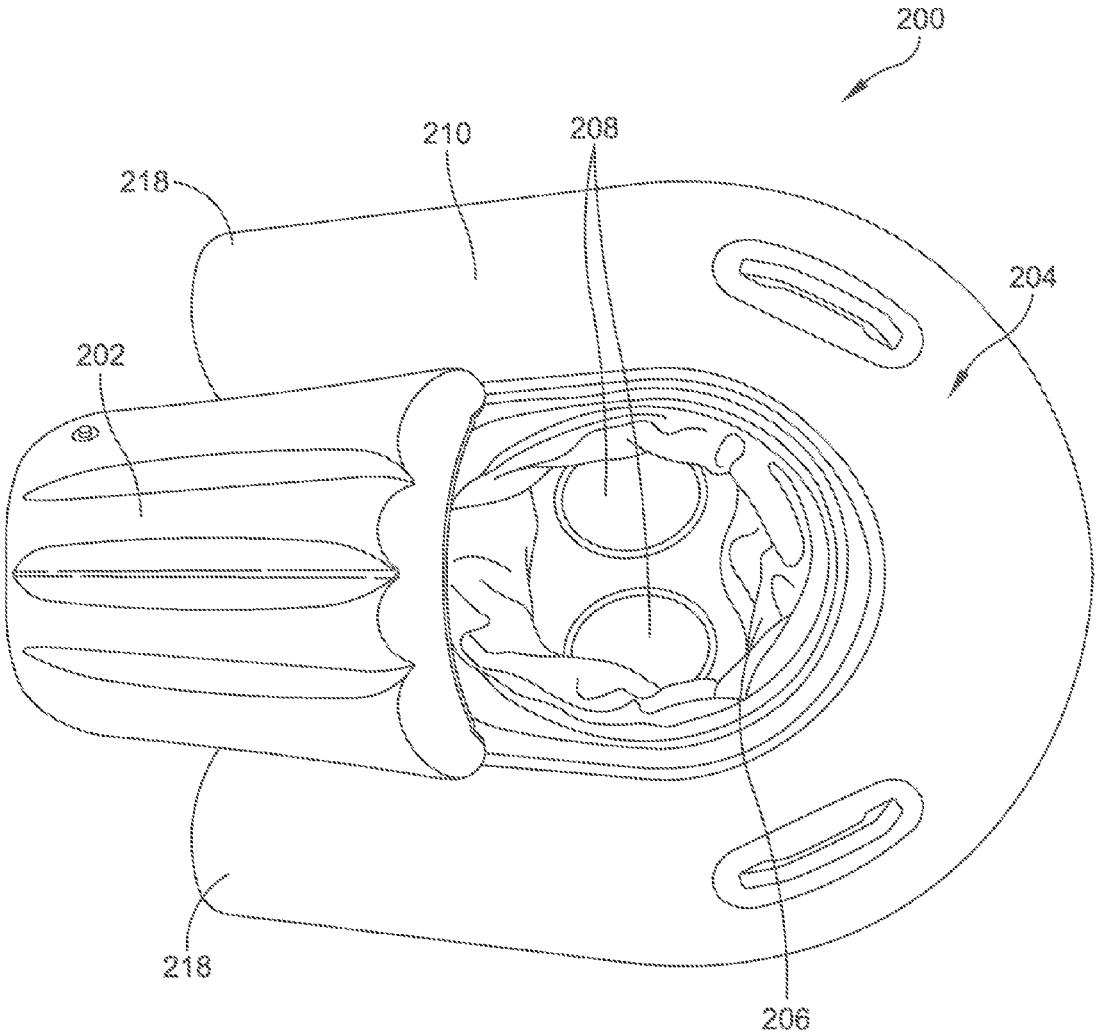
FIG. 3 is a top view of a flotation device arranged in a boat stage, according to an alternative embodiment.

According to one embodiment, the flotation tube 210 may include one or more inflatable chambers, with each of the chambers including a separate valve that allows each chamber to be inflated and/or deflated independently. In one example, the length of the flotation tube 210 is approximately 26 inches while the width of the flotation device is 25.5 inches. The flotation tube 210 may include one or more arches 214 forming hand-holds, as shown in FIG. 3. The arches 214 may be used to carry the recreational device 200 when outside the water and may be used for stability when the recreational device 200 is placed in water.

The well 206 is contoured and includes the apertures 208. The well 206 functions as a seat in the boat stage of assembly and supports the weight of the child in a sitting position. The apertures 208 may have an oval shape with a diameter large enough to easily allow the legs of a child to fit through in both the boat stage and in the extended stage of assembly. In one example, the length of the apertures is approximately 4.5 inches and the width of the apertures is approximately 3.25 inches.

The upper support 220 is contoured in a way as to allow a portion of the kickboard to rest uniformly on top of the upper support 220, in the boat stage of assembly or when the kickboard is stored within the boat portion 204. In one example, the well 206 can extend below the bottom plane of the flotation device. However, in other examples, the well 206 can be flush with the bottom plane of the flotation device. In one embodiment, the well 206 and the upper support 220 are smaller than the total length of the flotation tube 210.

Figure 8:
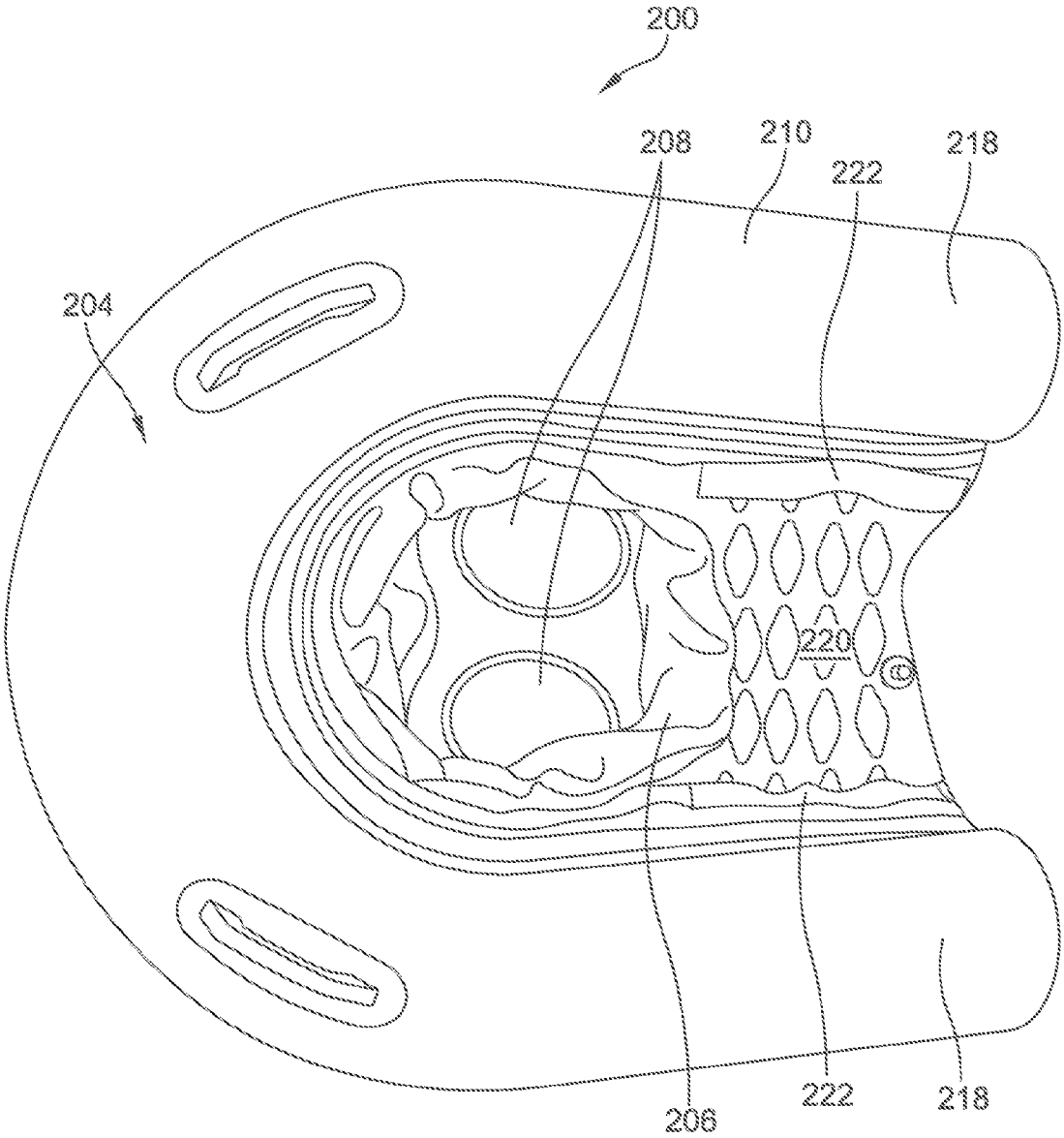
FIG. 8 is a top view of a flotation device arranged in a separation stage, according to an alternative embodiment.

According to other embodiments, the well 206, together with the upper support 220, can extend through the length of the flotation tube 210, as shown in FIG. 8. For example, the diameter of the well 206 is 10 inches and the length of the upper support 220 is 5 inches, as shown in FIG. 3, while the total length of the flotation device 200 is 26 inches. In another embodiment, as shown in FIG. 8, the well 206, without the support 220, can extend the entire length of the flotation device 200. Although the well 206 is shown as circular in shape, in other embodiments the well 206 may be elongated or oval in shape. In other embodiments, the well 206 may be rectangular or square in shape.

In one example, the kickboard 202 has an elongated shape and further includes a front end 224 and a rear portion 226. In one embodiment, as shown in FIG. 5, the edge of the rear portion 226 is contoured to fit around a child's torso, while the edge of the front end 224 is extends outside of the extensions 218 of the flotation tube 210. In another embodiment, as shown in FIG. 3, the edge of rear portion 226 is contoured to fit to the shape of the child's torso, while the edge of the front end 224 of the kickboard 202 may form a substantially straight edge. The kickboard shown in FIG. 3 is substantially rectangular with the front end 224 having a smaller width than the width of the rear portion 226.

In one embodiment, the kickboard includes two pairs of apertures or slits 216 which are disposed in the front end 224 and the rear portion 226 of the kickboard 202; first pair of slits in the front end 224 and second pair in the rear portion 226. In one example, the first pair of slits may be disposed perpendicular to the length of the kickboard and the second pair of slits is disposed parallel to the length of the kickboard. It is appreciated that the slits can be included in other orientations on the flotation device 200. The slits serve can dual functions. First, in one example, the slits can be configured to allow the fastening straps 212 to couple the kickboard 202 to the flotation tube 210, as shown in FIGS. 2 and 5. Second, the slits can also serve as hand holds for the child in the extended and the separation stages of assembly.

In an alternative embodiment, the kickboard 202 is uniform in shape and does not include slits 216 or fastening straps 212. Illustrated in FIG. 3, in this embodiment, the kickboard is fastened to the boat portion 204 by using Velcro® hook-and-loop fasteners. The hook and loop fasteners may be disposed on both sides of the kickboard 202 and on the inner side of flotation tube 210. For example, one portion of the hook and loop fasteners is placed on the upper support and another portion of the hook and loop fasteners is placed on one side of the kickboard.

As shown in FIG. 4, the fasteners can also be used to position and secure the kickboard 202 entirely inside the boat portion 204 for easy storage. It is appreciated that other releasable fastening mechanisms may be used to attach the kickboard 202 to the boat portion 204, including a snap, a clip, a button, a buckle, or a reusable adhesive.

Referring again to FIG. 2, in one embodiment, the proportions of the kickboard are configured such that the kickboard 202 can slide within the extensions 218 of the U-shape flotation tube 210 and rest on the upper support 220. The width of the front end 224 may match the outer width of the flotation tube 210. In another embodiment, the width of the front end 224 may match the inner width of the flotation tube. In one embodiment, the width of the rear portion 226 may match the inner width of the flotation tube 210, with the front end 224 being proportionally wider than the rear portion 226. In addition, front end 224 may be proportionally shorter than the length of the rear portion 226, and with the front end 224 extending beyond the extensions 218 of the U-shape flotation tube 210. In one example, the width of the front end 224 is approximately 10 inches. In one example, the length of the front end 224 is approximately a third of the length of the rear portion 226. In various examples, the length of the entire kickboard is approximately 15 inches.

In at least one embodiment, as shown in FIGS. 2 and 5, the fastening straps 212 are attached to the flotation tube 210 and fit through one pair of the slits 216 on the kickboard 202. The fastening straps 212 can keep the kickboard 202 secured to the flotation tube 210 in the boat stage and the extended stage of assembly, as shown in FIGS. 2 and 5 and discussed further below. In the boat stage, shown in FIG. 2, the fastening straps 212 attach to the first pair of slits 216 and in the extended stage, shown in FIG. 5, the fastening straps 212 attach to the second pair of slits. In another embodiment, as shown in FIGS. 3, 4 and 6, the hook and loop fasteners are configured to releasably attach the kickboard 202 to the boat portion 202.

According to one embodiment, elements of both the kickboard 202 and the boat portion 204 as described herein may be constructed of plastic material. For example, in one embodiment, the plastic material is Polyvinyl Chloride (PVC), reinforced PVC, PVC mesh, laminated PVC or any other plastic material.

FIG. 5 illustrates one example of the flotation device 200 in the extended stage of assembly. In the extended stage, the kickboard 202 is extended away from the boat portion 204 while still attached to the extensions 218 of the flotation tube 210. As shown, fastening straps 212 are attached to flotation tube 210 and fit around the second pair of slits of the kickboard. The kickboard 202 can be situated relative to the flotation tube 210 based on the child's size and comfort in the water. For example, as the child grows taller, the child can extend the kickboard may be placed farther away from the upper support 220 to match the child's height. In use, the child lays down in a swimming position on top of the kickboard 202 while the child's legs protrude through the apertures 208. In one example, the child can use the first pairs of slits as handholds, while the boat portion serves to support the weight of the child.

Figure 6:
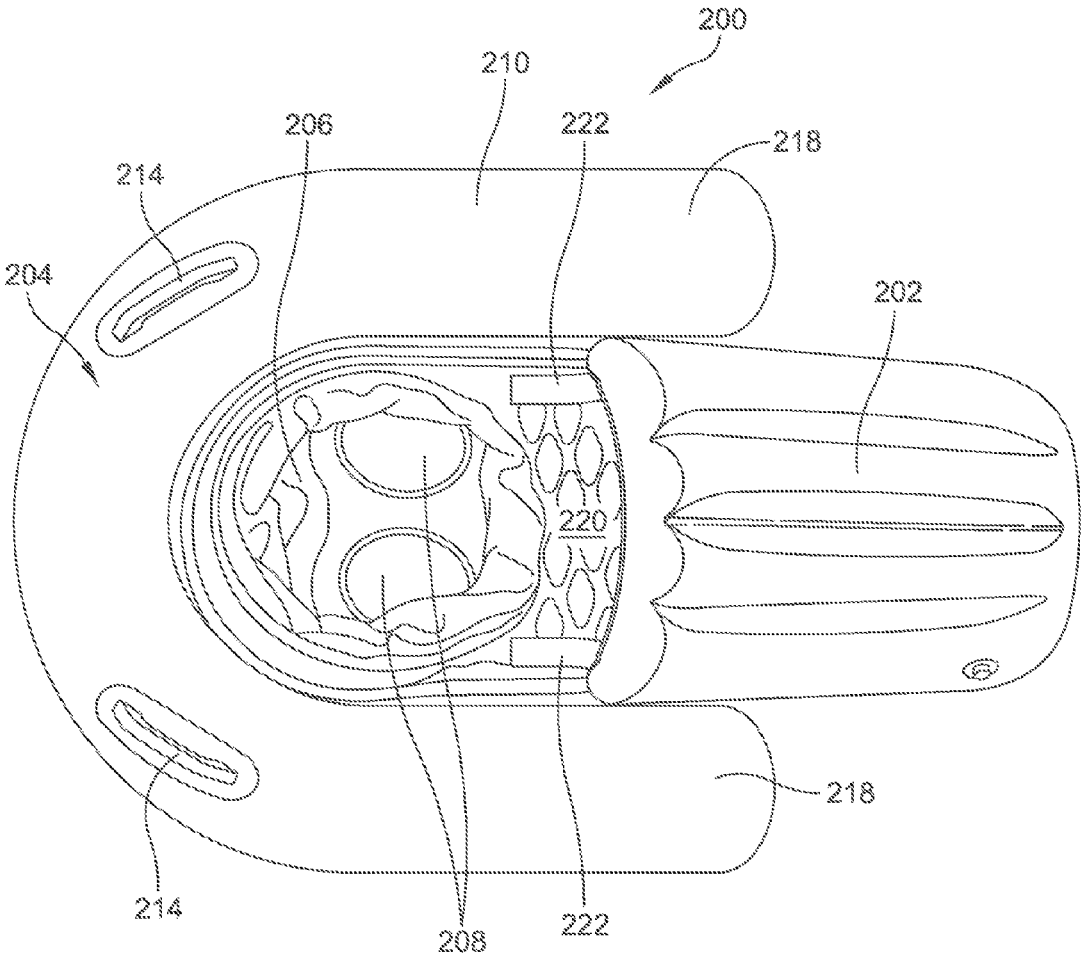
FIG. 6 is a top view of a flotation device arranged in an extended stage, according to an alternative embodiment.

Illustrated in FIG. 6, in an alternative embodiment, the flotation device 200 is shown in the extended stage of assembly. In this embodiment, the kickboard 202 has a uniform shape and does not include slits 216 or fastening straps 212. In this embodiment, the kickboard 202 can be attached to the boat portion 204 by using VELCRO® hook-and-loop fasteners 222. One portion of the fasteners may be disposed on the side of the kickboard (not shown), while the second portion may be disposed on the inner surface of the boat portion 204, as shown in FIG. 6. In this embodiment, the fasteners are disposed starting at the well 206, continuing through the length of the flotation tube 210, and ending at the extensions 218. However, it is appreciated that one or more hook and loop fasteners may be disposed on any portion of the upper support 220.

In this embodiment, the kickboard 202 can be placed in any position in relation to the boat portion 204 and can be progressively secured further away from the well 206 to accommodate for the growing size of the child. The hook and loop fasteners 222 provide enough strength to keep the kickboard in place, while a child is placed onto the kickboard. As shown in FIG. 6, the flotation device 200 is in the extended stage of assembly with the kickboard 202 extending away from the boat portion 204.

Figure 7:
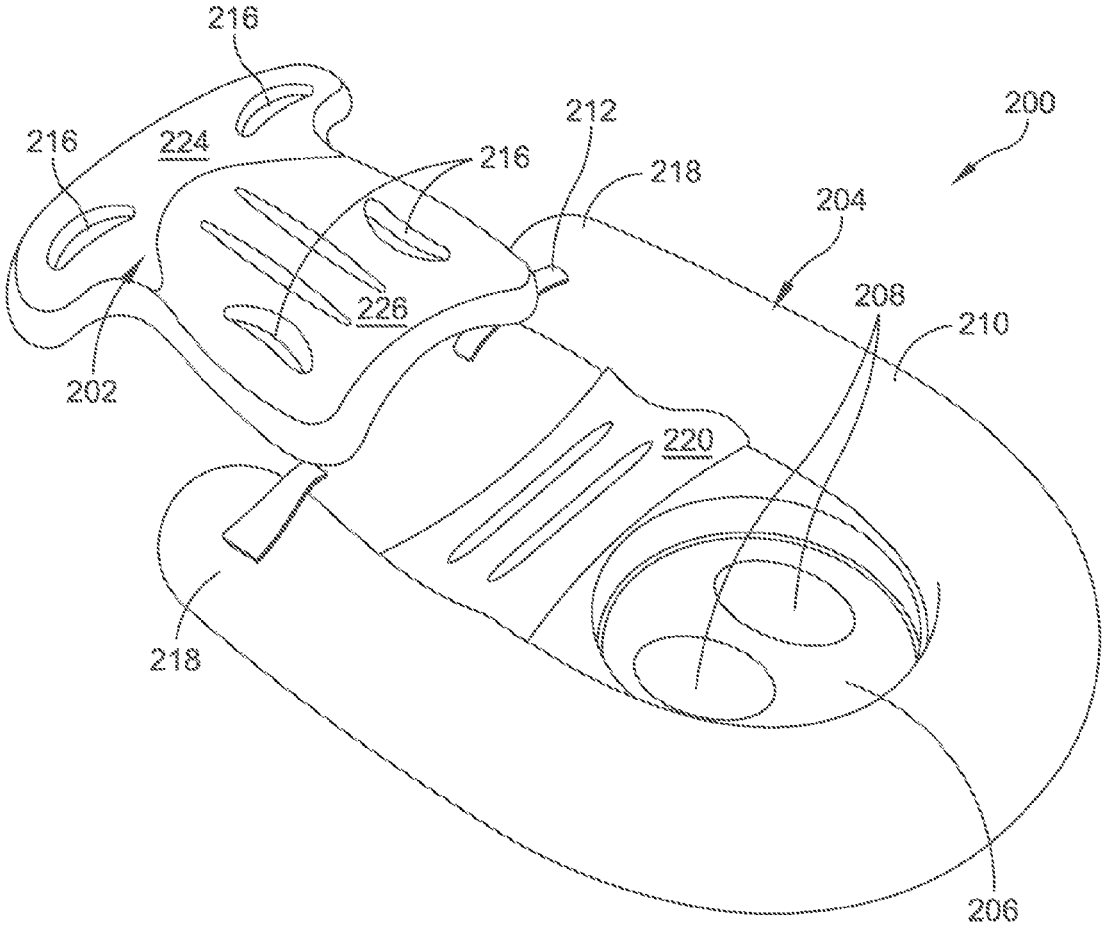
FIG. 7 is a perspective view of a flotation device arranged in a separation stage, according to one embodiment.

FIG. 7 illustrates one example of the flotation device 200 in the separation stage of assembly. In the separation stage, the kickboard 202 is separated from the boat portion 204 and can be used by the child independently of the boat portion 204. As shown, the fastening straps 212 are unfastened, but remain attached to the flotation tube 210. The boat portion 204 can be removed, deflated and stored. In this stage, the child feels more comfortable in the water and does not need the support of the boat portion 204.

FIG. 8 illustrates another embodiment, where the kickboard attaches to the boat portion using hook and loop fasteners and is shown in the separation stage of assembly, where the kickboard is removed from the boat portion 204. One portion of the hook and loop fasteners is shown and the upper support portion 220 is exposed.

As described above, children can sometimes feel cautious transitioning from a fully supportive, sitting flotation device to a less supportive kickboard. But through use of flotation device 200 in the various stages as described above, the child can gradually become accustomed to the swimming position. The flotation device 200 can be transformed from the boat stage to the extended stage and then to the separation stage to fit the child's stages of growth and comfort in the water.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A recreational flotation device comprising:

a U-shaped body having a front portion, and members disposed substantially parallel to each other, extending from the front portion, the U-shaped body comprising an inflatable tube, a seat comprising two openings configured to allow a user's legs to fit through the two openings, and an upper support, wherein the inflatable tube is contoured around and attached to the seat and the upper support; and a kickboard detachably coupled to the U-shaped body, disposed between the parallel members, wherein the kickboard is configured to be positioned within the U-shaped body in a plurality of positions.

2. The device of claim 1, wherein the kickboard placed in a second position of the plurality of positions is configured to be coupled to the U-shaped body and partially extending outside of the U-shaped body.

3. The device of claim 1, wherein the kickboard placed in a third position of the plurality of positions is configured to be detached and removed from the U-shaped body.

4. The device of claim 1, wherein the kickboard is contoured on one side to fit around a torso of the user.

5. The device of claim 4, wherein the upper support and the parallel members form a space configured to fit the kickboard.

6. The device of claim 1, wherein the seat is configured to support weight of the user in a sitting position.

7. The device of claim 1, wherein the upper support is contoured to allow at least a portion of the kickboard to rest uniformly on top of the upper support.

8. The device of claim 1, wherein the flotation device and the kickboard are inflatable.

9. The device of claim 1, wherein the kickboard is configured to be detachably coupled to the U-shaped body using hook and loop fasteners.

10. The device of claim 9, wherein hook and loop fasteners comprise a first portion of the hook and loop fasteners is disposed on the kickboard and a second portion of the hook and loop fasteners is disposed on the U-shaped body.

11. The device of claim 1, wherein the kickboard is configured to be detachably coupled to the U-shaped body using fastening straps.

12. A recreational flotation device comprising:

a main body having a front portion and members extending substantially parallel from the front portion;

a seat portion attached to the main body between the two parallel members and adjacent to the front portion, and having two openings configured to allow a user's legs to fit through the openings for receiving and supporting the user of the recreational flotation device in a seated potion; and a floating board removably attachable to said main body, when positioned between the parallel members.

13. The device of claim 12, wherein in a first position, the floating board is entirely positioned within the main body and removably attached thereto.

14. The device of claim 12, wherein, in a second position, the floating board is partly positioned within the main body and removably attached thereto.

15. The device of claim 12, further comprising a support member disposed between the parallel members and adjacent the seat portion, for supporting the floating board when the floating board is placed between the members.

16. The device of claim 12, wherein the kickboard is configured to be detachably coupled to the main body using a releasable fastening mechanism.

* * * * *